US005586699A

United States Patent [19]

Heisler et al.

[11] Patent Number: 5,586,699

[45] Date of Patent: Dec. 24, 1996

[54] BACKPACK SUPPORT

[75] Inventors: Kurt W. Heisler, McDonough; Richard S. Haddock, Endwell, both of N.Y.

[73] Assignee: Johnson Worldwide Associates, Inc., Sturtevant, Wis.

[21] Appl. No.: 597,347

[22] Filed: Feb. 6, 1996

Related U.S. Application Data

[63] Continuation of Ser. No. 195,707, Feb. 14, 1994, abandoned.

[51] Int. Cl.[6] ..... A45F 3/04; A45F 3/08

[52] U.S. Cl. ..... 224/628; 224/627; 224/632; 224/259; 224/261

[58] Field of Search ..... 224/627, 628, 224/629, 631, 632, 633, 635

[56] References Cited

U.S. PATENT DOCUMENTS

| | | | |
|---|---|---|---|
| 3,536,237 | 10/1970 | Greenman | 224/262 |
| 3,938,718 | 2/1976 | Madison | 224/262 |
| 4,135,654 | 1/1979 | Chu | 224/261 |
| 4,217,998 | 8/1980 | Alexander . | |
| 4,369,903 | 1/1983 | Wilkes . | |
| 4,489,866 | 12/1984 | Korte . | |
| 4,842,173 | 6/1989 | Scherer | 224/210 |
| 5,004,135 | 4/1991 | Dufournet et al. | 224/210 |
| 5,090,604 | 2/1992 | Howe . | |
| 5,284,279 | 2/1994 | Sason et al. | 224/209 |
| 5,361,955 | 11/1994 | Gregory | 224/215 |

FOREIGN PATENT DOCUMENTS

| | | | |
|---|---|---|---|
| 2677235 | 12/1992 | France | 224/209 |
| 2223930 | 4/1990 | United Kingdom | 224/211 |
| 21265 | 12/1992 | WIPO | 224/210 |

*Primary Examiner*—Henry J. Recla
*Assistant Examiner*—Charles R. Eloshway
*Attorney, Agent, or Firm*—Foley & Lardner

[57] ABSTRACT

A rectangular frame for supporting the backpack having a pair of shoulder straps, the frame including a pair of cross members and a pair of fittings for securing the shoulder straps to the frame, the fittings including a main section having a series of parallel slots, a semi-circular member at each end of the main section for securing the fittings to the cross members and a slotted ring mounted on each shoulder strap, the ring being of a size to pass through the slots and rotatable with respect to the shoulder strap to lock the strap in the slots in the fitting.

9 Claims, 1 Drawing Sheet

BACKPACK SUPPORT

This is a file wrapper continuation of application Ser. No. 08/195,707 filed Feb. 14, 1994, abandoned.

FIELD OF THE INVENTION

The present invention relates to a backpack frame and more particularly to a pair of adjustable fittings which can be selectively positioned on the frame to provide a number of adjustment positions for securing the shoulder straps to the frame.

BACKGROUND OF THE INVENTION

Conventional backpacks are generally in the form of vertically projecting frames of metal or the like, adapted to be worn on the backpacker's back, to which are attached at vertically spaced intervals a pair of forwardly extending shoulder straps, each strap forming a loop with the rear frame. Most conventional backpacks also have a shoulder pad and certain ones in the bottom of the rear frame are shoulder straps connected to a padded or unpadded hip or back belt. The load to be carried is generally tied to the rear frame so that as described above the center of gravity of the entire assembly when the backpacker is standing with the backpack in place is behind the backpacker's vertical midline. This usually causes the packer to feel pulled back and offbalance and to try and compensate for this by hunching forward and a repeatedly pulling forward and down on the backpack shoulder straps in order to help shift the backpack load up and forward to a position more closely adjacent to the vertical midline. However, walking while hunched forward is inefficient and tiring, placing considerable strain on back muscles and restricting a free and easy gait. Moreover, repeatedly tugging at the backpack shoulder straps while walking is also tedious and distracting resulting in a repeated shifting back and forth of the center of gravity of the backpack.

SUMMARY OF THE PRESENT INVENTION

The present invention relates to a backpack frame assembly and more particularly to the fittings which are mounted in the frame to accommodate changes in the height and width of the backpacker. In this regard the fittings are mounted on cross members in the frame assembly by simply aligning pins provided in the fittings with openings provided in the cross members and snapping the upper end of the fittings to the upper cross member. The fittings should be so located that they are aligned with the width of the shoulders of the backpacker. Slotted rectangular rings are provided on the shoulder straps which are aligned with the openings in the fittings so that the straps are secured to the openings above the shoulders of the backpacker. The straps thereby hold the backpack in a generally vertical position whereby the full weight of the pack is carried on the hips of the backpacker.

One of the advantages of the present invention is the provision of a fitting and a ring which can simply and easily be adjusted to place the weight of the backpack on the hips of the backpacker.

Other principal features and advantages of the invention will become apparent to those skilled in the art upon review of the following drawings, the detailed description and the appended claims.

Figure 1:
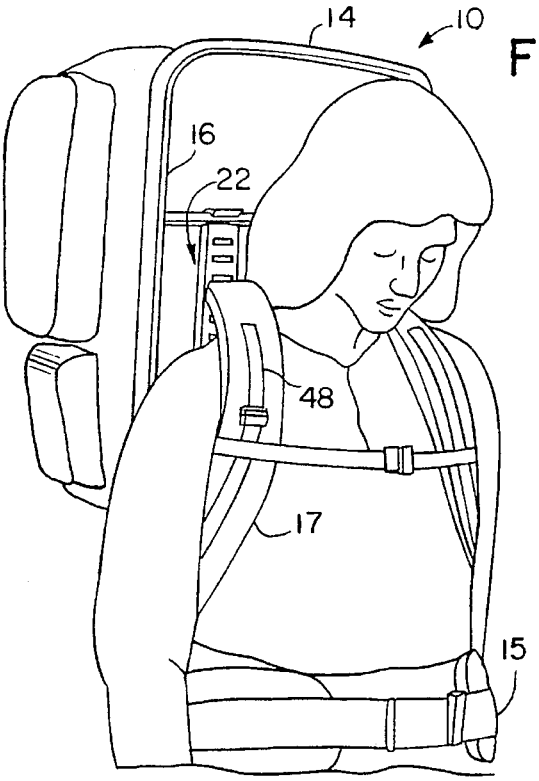
FIG. 1 is a schematic view of the improved backpack frame of the present invention shown in position on a backpacker.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
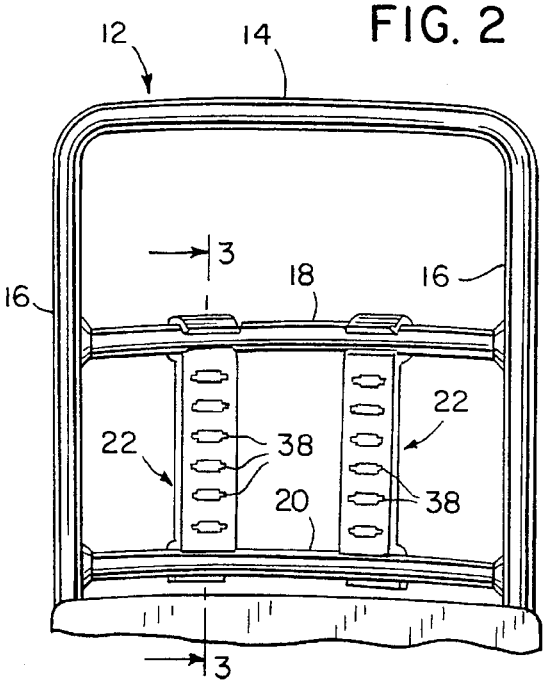
FIG. 2 is a view of a portion of the frame showing the shoulder strap fitting mounted on the cross members of the frame.

Referring to FIG. 1 of the drawings the improved backpack frame 10 of the present invention is shown in place on a backpacker. The backpack frame 10 generally includes a rectangular frame member 12 which is preferably formed from lightweight tubing, generally aluminum, bent into an elongated rectangular configuration as illustrated in FIGS. 1 and 2. The frame 12 has an upper cross member 14 and a pair of tubular side members 16. A pair of intermediate cross members 18 and 20 are spaced apart a distance to accommodate a pair of fittings 22. As generally understood in the art the cross members 14, 18 and 20 are curved to accommodate the shoulders of the wearer. The lower end of the frame is supported on the hips of the backpacker by a belt 15. Shoulder straps 17 are provided for connection to the fittings 22 which allow for adjustment of the connection of the shoulder straps 17 to accommodate for changes in the height of the backpacker. The shoulder straps 17 should be connected to the fittings 22 such that the straps only hold the frame in an upright position on belt 15 and do not place any weight on the shoulders of the backpacker.

Figure 3:
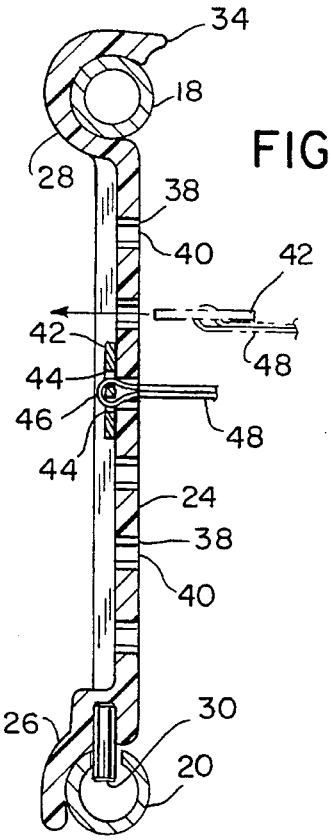
FIG. 3 is a cross section of the fitting taken in line 3—3 of FIG. 2.

In accordance with the present invention a pair of fittings 22 are shown positioned between the cross member 18 and the cross member 20. Each fitting as shown in FIG. 3 is formed from a plastic material having a main section 24, a curved quarter section 26 on the lower end of each main section and a semi-circular half section 28 on the upper end of each main section.

The curved quarter section 26 has a radius of curvature corresponding to the diameter of the cross member 20. The lower end of the main section 24 is secured to the lower cross member by means of a pin 30 embedded in the lower end of the main section 24. The pin 30 is positioned to engage one of a number of holes 32 provided on each side of the cross member 20. The holes provide increasing widths to accommodate the width of the shoulders of the backpacker.

The semi-circular member 28 on the upper end of the fitting has a radius of curvature corresponding to the radius of curvature of the upper member 18. The semi-circular member 28 has a curvature slightly greater than half the curvature of the cross member to form a snap fit with the curvature of the cross member 18. A lip 34 is provided on the upper end of the circular member 28 to aid in releasing or snapping the semi-circular member onto or off of the upper cross member 18. A semi-circular member 28 as described above could be provided at both ends of the fitting. The pin 30 would then not be required.

Figure 5:
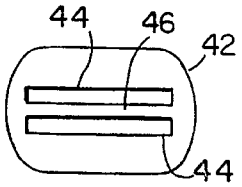
FIG. 5 is a view of the rectangular ring.
Figure 4:
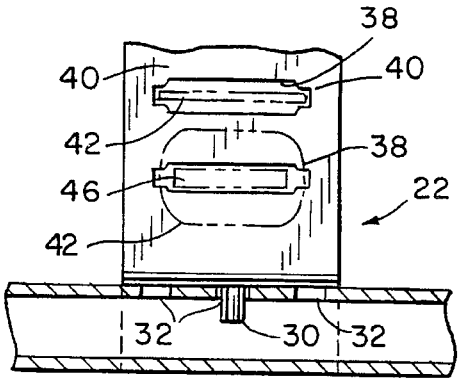
FIG. 4 is a cross section of a portion of the lower cross member showing the connection of the fitting to the cross member.

Each of the fittings 22 includes a series of slots 38, each slot is in the form of a rectangle having a small groove 40 at each end. A rectangular ring 42, as shown in FIG. 5, includes a pair of slots 44 located on each side of a centrally located bar 46. The shoulder strap 48 is looped through the slots 44 on each side of the bar 46 for attaching the ring 42 to the shoulder strap. The ring 42 has a length greater than the slot 38 and smaller than the distance between the grooves 40. The ring 42 is positioned in a perpendicular relation to the fitting in alignment with the grooves 40 as shown in FIGS. 3 and 4. The ring is pushed through the grooves 40 with the strap 48 aligned with the groove 38. After passing through the slots 30 the ring is pivoted 90° with respect to the strap so that the ring abuts the back of the fitting when the strap is pulled by the backpacker.

It should be noted that the ring should be adjusted in the slots 38 so that the end of the strap is located above the shoulders of the backpacker. With this arrangement the weight of the backpack is carried on the hips of the backpacker so that the weight of the backpack is not carried on the shoulders of the backpacker. The straps 17 being used to maintain the backpack in a generally vertical position with respect to the belt 15.

Thus, it should be apparent that there has been provided in accordance with the present invention a backpack support that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. In a rectangular frame for supporting a backpack having a pair of shoulder straps and a rigid frame having cylindrical upper and lower cross members, the improvement comprising a pair of rigid vertical fittings for securing the shoulder straps to the frame, each of said fittings including a main section having a series of parallel slots, means at each end of said main section for securing said fittings in a perpendicular spaced relation to said upper and lower cylindrical cross members, said securing means comprising a curved member on one end of each of said fittings having a curvature slightly greater than half the curvature of the upper cross member, the curved member being sufficiently flexible to form a snap fit with said upper cross member, and a flat slotted ring mounted on each shoulder strap, said ring being of a size to pass through said slots and being rotatable with respect to the shoulder straps to lock each strap in one of the slots in said fittings.

2. The fittings according to claim 1 wherein each of said slots has a rectangular shape and a groove at each end of each slot to allow the rings to pass through the slots.

3. The fittings according to claim 1 wherein said means for securing said fittings to said cross members comprises a curved member on an upper end of said fittings having an opening smaller than the diameter of the upper cross member and being sufficiently flexible to form a snap fit with said cross member.

4. The fittings according to claim 3 each including a pin at a lower end of said fitting for engaging one of a number of openings on each side of the lower cross member.

5. The fittings according to claim 4 wherein each of said slots has a rectangular shape and a groove at each end of each slot to allow the rings to pass through the slots.

6. The fittings according to claim 5 wherein said rings have a length greater than the width of said slots and smaller than the distance between said grooves at each end of each slot.

7. The fittings according to claim 3 wherein each of said fittings has a curved quarter section on the other end of said fitting.

8. The fittings according to claim 7 wherein each of said slots has a rectangular shape and a groove at each end of each slot.

9. The fittings according to claim 8 wherein said rings have a length greater than the width of said slots and smaller than the distance between said grooves at each end of each slot.

* * * * *